US011078623B2

(12) United States Patent
Ding et al.

(10) Patent No.: US 11,078,623 B2
(45) Date of Patent: Aug. 3, 2021

(54) MULTI-LAYER MATERIAL AND METHOD OF APPLICATION

(71) Applicants: Jian Ling Ding, Glastonbury, CT (US); Arthur Victor Fleury, Jr., Conentry, RI (US); Charles E. Snyder, Southwick, MA (US); Jason Curtis Hinkle, Agawam, MA (US); Daniel T. Bunker, Northampton, MA (US)

(72) Inventors: Jian Ling Ding, Glastonbury, CT (US); Arthur Victor Fleury, Jr., Conentry, RI (US); Charles E. Snyder, Southwick, MA (US); Jason Curtis Hinkle, Agawam, MA (US); Daniel T. Bunker, Northampton, MA (US)

(73) Assignee: NEENAH NORTHEAST, LLC, West Springfield, MA (US)

( * ) Notice: Subject to any disclaimer, the term of this patent is extended or adjusted under 35 U.S.C. 154(b) by 759 days.

(21) Appl. No.: 13/748,201

(22) Filed: Jan. 23, 2013

(65) Prior Publication Data

US 2013/0186546 A1 Jul. 25, 2013

Related U.S. Application Data

(60) Provisional application No. 61/590,171, filed on Jan. 24, 2012.

(51) Int. Cl.
*D06N 3/00* (2006.01)
*D06N 3/14* (2006.01)

(52) U.S. Cl.
CPC ..... *D06N 3/0047* (2013.01); *D06N 3/0011* (2013.01); *D06N 3/0077* (2013.01); *D06N 3/14* (2013.01); *Y10T 156/10* (2015.01); *Y10T 428/24504* (2015.01); *Y10T 442/649* (2015.04); *Y10T 442/652* (2015.04)

(58) Field of Classification Search
CPC ..... D06N 3/00; B31D 3/02
USPC ..... 442/374, 63, 221; 428/36.4, 116, 141, 428/304.4, 340, 317.1, 318.6, 319.7; 159/77, 79, 60, 153, 324
See application file for complete search history.

(56) References Cited

U.S. PATENT DOCUMENTS 3,066,043 A * 11/1962 Hechtman ..... C09J 7/201 442/151
3,649,398 A * 3/1972 Keith ..... 156/79
3,652,747 A 3/1972 Hirobaru et al.
(Continued)

FOREIGN PATENT DOCUMENTS

EP 1990392 B1 3/2001
EP 1990392 A1 * 11/2008 ..... C08F 265/04
(Continued)

OTHER PUBLICATIONS

International Search Report dated Apr. 11, 2013 from corresponding PCT Patent Application No. PCT/US2013/00022.
(Continued)

*Primary Examiner* — Lynda Salvatore
(74) *Attorney, Agent, or Firm* — Grogan, Tuccillo & Vanderleeden, LLP

(57) ABSTRACT

A multi-layer material suitable for use as a covering for an article includes a polymeric cellular layer and nonwoven backing layer. The multi-layer material having a creasability angle of between about 20 and about 160 degrees.

20 Claims, 1 Drawing Sheet

(56) References Cited

U.S. PATENT DOCUMENTS

| | | | | |
|---|---|---|---|---|
| 4,048,269 | A | 9/1977 | Wisotzky et al. | |
| 4,849,278 | A * | 7/1989 | Stokes | 428/153 |
| 5,830,548 | A * | 11/1998 | Andersen et al. | 428/36.4 |
| 6,271,276 | B1 | 8/2001 | Gribble et al. | |
| 2007/0204381 | A1 | 9/2007 | Thompson et al. | |
| 2008/0200891 | A1* | 8/2008 | Kim et al. | 604/369 |
| 2010/0143652 | A1* | 6/2010 | Stockton | A61K 8/0208 428/141 |
| 2011/0151738 | A1 | 6/2011 | Moore et al. | |

FOREIGN PATENT DOCUMENTS

| | | | |
|---|---|---|---|
| GB | 1338699 | A | 11/1973 |
| WO | 2003074774 | A1 | 9/2003 |
| WO | 2004094494 | A2 | 11/2004 |

OTHER PUBLICATIONS

Supplementary European Search Report dated Sep. 7, 2015 from the corresponding European Patent Application No. 13741228.

* cited by examiner

MULTI-LAYER MATERIAL AND METHOD OF APPLICATION

CROSS REFERENCE TO RELATED APPLICATIONS

The present application claims the benefit of provisional patent application Ser. No. 61/590,171, filed Jan. 24, 2012, which is hereby incorporated by reference in its entirety.

FIELD OF THE INVENTION

The present disclosure relates generally to a multi-layer material and more particularly to a composite cover material with improved creasability having a nonwoven substrate layer and polymer based cellular layer.

BACKGROUND OF THE INVENTION

Today, many journals, diaries, book covers, boxes and like include a functional and/or decorative cover. In particular, elastomeric composites, such as consolidated polyurethanes, are often utilized for such covers. These composites are used for their softness and their ability to simulate other materials, such as leather. The elastic memory of these composites, however, presents problems in covering processes. Specifically, the material tends to pull away from the target surface when the composite has been folded over an edge or over a corner of the surface.

In view of the above, there is a need in the covering industry for a material that delivers the look and feel of leather, or other decorative material, that may be easily and efficiently applied to substrate during the covering process.

SUMMARY OF THE INVENTION

An embodiment of the present invention is a multi-layer material suitable for use as a covering for an article includes a polymeric cellular layer and nonwoven backing layer. The multilayer material having a creasability angle of between about 20 and about 160 degrees.

In another embodiment, a multi-layer material suitable for use as a covering for an article includes a polyurethane cellular layer and a nonwoven backing layer. The material also includes at least one coating on the polyurethane cellular layer. The material has a creasability angle of between about 50° and about 130°.

In yet another embodiment, a method of manufacturing a multi-layer material suitable for use as a covering includes entraining air or gas into a polymer to create a polymer froth and applying the polymer froth in a uniform layer to a nonwoven backing layer resulting in a multi-layer material that has a creasability angle of between about 20 and 160 degrees.

In another embodiment, a method of covering an article with a multi-layer material include the steps of applying an adhesive to either the article or to a nonwoven backing layer of the material and placing the material on the article. The material includes the nonwoven backing layer as well as at least one polymeric cellular layer and the material has a creasability angle of between about 20 and 160 degrees.

BRIEF DESCRIPTION OF THE DRAWINGS

The present invention will be better understood from reading the following description of non-limiting embodiments, with reference to the attached drawings, wherein below.

DETAILED DESCRIPTION OF THE INVENTION

Figure 1:
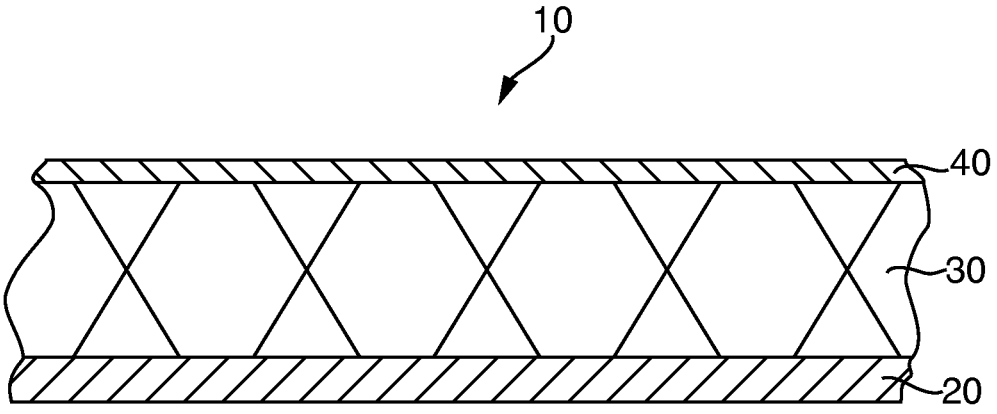
FIG. 1 is a sectioned side view of a composite structure having a three layered system in accordance with an embodiment of the present disclosure.

Reference will be made below in detail to exemplary embodiments of the invention, examples of which are illustrated in the accompanying drawings. Wherever possible, the same reference numerals used throughout the drawings refer to the same or like components. Although exemplary embodiments of the present invention are described with respect to a cover material for journals, diaries, book covers, boxes and like, embodiments of the invention may also be used with other articles that may benefit from a textured/ornamental or functional appearance. Such articles may include cabinetry and wallpaper among many other articles and applications.

As used herein, the terms "substantially," "generally," and "about" indicate conditions within reasonably achievable manufacturing/assembly tolerances and test measurements.

With reference to FIG. 1, material 10 is disclosed as having multiple layers that provide an improved creasability. In an embodiment, these layers include a polymeric cellular structure 30, referred to herein as cellular layer 30, and a nonwoven backing substrate, referred to herein as backing layer 20. In certain embodiments, a coating 40 may be applied over the polymeric cellular structure 30, as will be discussed in greater detail below.

With respect to the backing layer 20, a wide variety of nonwoven substrates can be used. As will be appreciated, the nonwoven substrate's thickness, density, component fiber length, fiber denier, fiber composition, method of construction, saturation levels, and other properties contribute to the desired creasability of the base sheet. Preferred backing layer substrates are nonwoven, cellulose based paper that deform under a force and retain a portion of the deformation once the force is released. A wide variety of cellulose based substrates that are available for use as the base substrate and can include: wood containing paper, non-wood containing paper, kraft, bleached kraft, latex saturated paper, and creped versions of each, as well as, many others known in the art.

Alternative substrates such as synthetic nonwovens, textiles, films, release liners, and similar materials can be used singly, combined with, or added to the nonwoven cellulose based substrate, as a supporting layer or for decorative appeal. For example, a cellulose based non-woven paper saturated with latex may be used as a backing layer. If used, latex saturated papers containing from about 5% to about 100% saturation based on dry fiber content are preferred, latex saturated papers of about 8% to about 75% saturation based on dry fiber content are more preferred, and latex saturated papers of about 12% to about 60% based on dry fibers content are most preferred.

Moreover, in certain embodiments, a primer coat or tie coating (not shown) can be applied directly to the backing layer 20 prior to application of a froth to enhance adhesion between the cellular layer 30 and backing layer 20. Tie coating compositions and application methods are well known to those skilled in the art.

Referring again to FIG. 1, an outfacing side of the base layer 20 is covered by the polymeric cellular layer 30. In an embodiment, the cellular layer 30 is a flexible polymer matrix having open and closed cells containing air or non-reactive gas and having a density in the range of about 0.15 g/cc to about 0.8 g/cc. It has been determined, however, that closed and open cells in a density range of about 0.2 g/cc to about 0.5 g/cc are more preferred, and a structure of open and closed cells in a density range of about 0.2 g/cc to about 0.35 g/cc is most preferred. The thickness of the cellular substrate can range from about 0.002 to about 0.300 inches, and, more preferably, from about 0.010 to about 0.050 inches.

A wide variety of elastomeric and blends of elastomeric polymers are suitable for use in the cellular layer 30, such as polyurethane, styrene butadiene, acrylic, vinyl acrylics, neoprene, EVA, natural rubber, EPDM, and others known in the art. Water based emulsions and blends of water-based emulsions of polyurethanes, polyacrylics, polystyrene butadiene rubbers, and polyethylene vinyl acetates are particularly suitable. Examples of elastomeric polymers as latexes for generation of the cellular layer 30 include elastomeric polyacrylics such as Hycar26322™ from B.F. Goodrich, Joncryl 74-A and Joncryl 2640 from BASF, HyStretch V60, HyStretch V43, HyStretch V29, Carbobond 26387 and HyCar 26138 from Lubrizol. They further include elastomeric polyurethane latexes, such as Unithane IC-487-SF, Unithane-IC-407-SF and Unithane IC-807-SF from Union Specialties, Witcobond® W170, Witcobond® 290H and, Witcobond® W391-64 from Witco and elastomeric polystyrene butadiene rubbers such as Genflo 8152 from Omnova and Butofan NS 209 from BASF. Elastomeric polynitrile butadiene latex such as Hycar 1562×159 from Emerald Performance Materials may also be used. Suitable elastomeric polymers may also include elastomeric polyvinylacrylic latex such as Suncryl RQ-41 PF from Omnova and elastomeric polyurethane-polyacrylic copolymer latexes such as Witcobond® A100 from Witco and Titan T6301, T6330 and T6300 from Para-Chem® by Royal Coating and Specialty Polymers.

In certain embodiments, pigment fillers, dyes, and other colorants, can be included in the cellular layer 30 to deliver a desired visual and/or tactile effect.

In an embodiment, the cellular layer 30 is generated from a froth of the desired polymer or combination of polymers and may be formed by any process that intentionally entrains air or gas into a liquid or a solid. For example, air entrainment may be created through mechanical shear with air or gas (e.g. nitrogen gas, Freon or other not reactive gas) injection into the mixing zone, chemical reaction that produces a gas that creates a void, heat activated blowing agents, and other processes that are known in the art. Polymer froth may also be produced during polymerization in the presence of a blowing agent, (e.g., production of frothed consolidated polyurethanes are well known in the art via reaction of polyisocyanate and a polyol containing hydroxyl groups, the presence of a catalyst and a blowing agent). A preferred method of air entrainment is mechanical generation of froth at a density ranging from about 0.5 to about 8 lb/gal by metering pressurized air or gas into a latex polymer liquid stream.

A method of manufacturing the presently disclosed coating according to an embodiment of the present invention is now described. The polymeric cellular layer 30 is attached to the base layer 20 through adhesion that results from application of froth directly to the base layer 20 and curing (evaporating excess water), reaction to generate the froth from materials placed on the base layer 20 with subsequent curing and saturation of the base layer 20 with the froth, or addition of reactants to generate froth with subsequent reaction and curing.

An elastomeric polymer emulsion is then frothed and applied in a puddle to the base layer 20. The amount of elastomeric polymer emulsion is metered into a uniform layer using a blade or other metering method to achieve the desired wet coating thickness. The froth is cured by evaporating the excess water to below about 10% final solids content by drying at room temperature air over several hours, placing in a heated oven between about 200° to about 400° F. for several minutes, placing in a heated air stream at about 190° F. to about 300° F. for several seconds, or by any other method known in the art. Drying the froth results in a polymeric cellular layer 30 adhered to the base layer 20.

Multiple polymeric cellular layers 30 can be used to adjust tactile properties, for support, for design, for visual appeal, or for other desirable functional properties.

As mentioned previously, in certain embodiments a coating 40 may be applied to the facing surface of the polymeric cellular layer 30 to change the function, durability, color, and/or tactile and visual aesthetics of the cover material 10. The coating 40 may be a composite and may be singularly applied or applied in combinations. Suitable coatings may include latex emulsions, but are not limited to the following: polyurethanes, polyacrylics, polystyrene butadiene, polyethylene vinyl acetate, vinyl acetate ethylene polymers, polyolefins, or any combination thereof. In addition, the coating 40 may contain pigment fillers like clay and calcium carbonate particles, dyes, pigments, and other colorants, as well as, other components for processing and/or functional properties.

Multiple coating layers 40 can be used to adjust tactile properties, for visual appeal, or for other desirable functional properties.

In addition to a coating layer 40, a further mechanical process can be applied to the structure to achieve a desired texture. Embossing is a process of creating a three-dimensional image or design from a flat sheet in which a raised surface is imprinted by applying a combination of pressure and heat over time to the structure. The techniques of embossing are known to those skilled in the art.

EXAMPLES

The following examples are illustrative of multi-layered materials according to embodiments of the present invention. They are not intended to limit the scope, but are merely intended to be representative of the present disclosure.

Creasability Testing.

Figure 2:
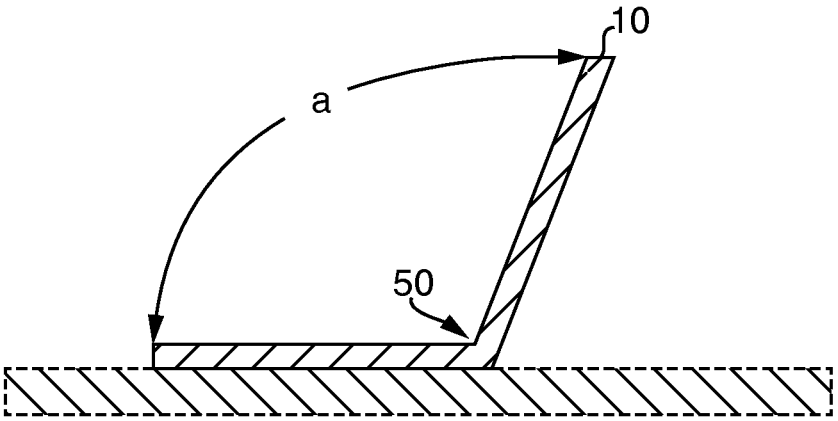
FIG. 2 is a sectioned side view of a composite structure in accordance with an embodiment of the present disclosure in a creased configuration.

A material according to an embodiment of the present invention has an improved creasability characteristic, which has not been addressed in the packaging market. With reference to FIG. 2, one way to test the creasability characteristic is to impart a crease 50 into the material 10 and measure the rebounding or crease angle $\alpha$ of the substrate. Many nonwovens and textiles have almost instantaneous rebounding properties; whereas paper based nonwovens do not. To test this property, the two edges of a 4-inch by 4-inch sample are placed together so that an outward face is touching itself. While being held in this position, a 20-pound weight is rolled over the sample to impart a crease. One edge is then held against a flat surface while releasing the other edge. After thirty seconds, the crease angle $\alpha$ that forms between the edge that is held down and the edge that rebounds when released is measured. The maximum angle of rebound, i.e., crease angle, is 180 degrees (indicating a complete rebound, flat), and a minimum angle of rebound is 0 degree (indicating no rebound). The result of this test determines the extent to which the tested material will hold a crease immediately following the fold. The implication is that the better the material holds the crease the easier it will be to wrap around corners and edges during the covering processes.

The following examples of the present disclosure reference the creasability characteristics of the respective material based on this test method. In particular, the term "creasability angle" as used herein is the crease angle determine through the aforementioned test.

Example 1

In this example, a fully reacted polyurethane froth was applied to the felt side of a cellulose base stock, i.e., cellulose backing layer, that was 0.006 inches thick. A polyurethane polymer system, such as Unithane FC-807SF, was mechanically frothed. The froth was cast to the base stock as a 0.010 inch wet coating and a 0.020 inch wet coating and then the structures were placed in the oven at 110 degrees Centigrade for three minutes. The total thicknesses of the cured structures (combined cellulose backing layer and polymeric cellular substrate) were 0.0134 inches and 0.0212 inches thick respectively and basis weights of 105 lb/3000 $ft^2$ and 128 lb/3,000 $ft^2$. The creasability angles were 58° first coating and 77° for the second coating.

Example 2

This example applied a fully reacted polyurethane polymer to the wire side of a cellulose base stock, i.e., cellulose backing layer, that was 0.006 inches thick, using a mechanical frothing device. The backing layer was a latex saturated flat paper. A fully reacted polyurethane, HH113866T1, was mechanically mixed to form a frothed mixture. The mixture was applied to the wire side of the base stock and then was dried for two minutes at 115 degrees Centigrade. The finished structure had good feel and appearance with a uniform surface. The total thickness of the material was 0.017 inches with a basis weight of 125 #/3,000 $ft^2$. The creasability angle was 83 degrees.

Example 3

This example is of an acrylic-polyurethane cellular layer on a cellulose backing layer that was 0.006 inches thick. An acrylic polymer system, Joncryl 74 A™, was blended with polyurethane latex, HH113866T1, in a 74:26 ratio based on dry solids and mechanically frothed. The froth was applied to the coated side of a cellulose backing layer with a latex bond coat. The product was cured at 110 degrees Centigrade for two minutes. The resulting material had a stiffer surface and poor adhesion to the base sheet than either example 1 or 2. The thickness of the cured structure was 0.011 inches with a basis weight of 124 lb/3,000 $ft^2$. The creasability angle was 54 degrees.

Example 4

This example applied two separate polyurethane layers to a cellulose backing layer using a casting sheet and a standard lamination technique. First, polyurethane froth was mechanically generated and applied to a fine leather grain casting sheet. The layer of polyurethane was dried in the oven at 110 degrees centigrade for one minute. Next, a separate layer of polyurethane froth was applied to a cellulose base sheet and dried at 110 degrees centigrade for two minutes. Finally, the layer of polyurethane attached to the casting sheet was laminated to the layer of polyurethane on the base sheet that was 0.006 inches thick using lamination glue and dried for 4 minutes at 120 degrees Centigrade. The casting sheet was peeled away to reveal the final material. The thickness of the cured structure was 0.021 inches with a basis weight of 168 #/3,000 $ft^2$. The creasability angle was 100 degrees.

Example 5

In this example, a multi-layered material was created having a cellulose backing layer that was 0.006 inches thick, a polyurethane cellular layer, and a casting sheet on the surface. The froth was generated using a mechanical device and applied directly to the cellulose backing layer. The froth-covered backing layer was then placed in the oven at 120 degrees Centigrade for one minute. Next, the backing layer and semi-dried cellular layer/froth were removed from the oven and a casting sheet was placed on the wet froth facing surface to form a three layered system. The resulting structure was put back into the oven for 4 minutes. The structure was removed from the oven and the casting sheet was peeled away revealing embossed cellular layer that was adhered to a cellulose substrate. The thickness of the structure was 0.012 inches with a basis weight of 113 #/3,000 $ft^2$. The creasability angle was 70 degrees.

Example 6

This example was a multiple layered system with a cellulose backing layer that was 0.006 inches thick, a polyurethane cellular layer like those in example 1, and multiple coating layers on the surface. A mechanically produced polyurethane froth was applied to a cellulose based substrate and placed in the oven at 120 degrees for three minutes. The structure was removed from the oven and printed with a gravure roller on the cellular layer facing surface and placed in the oven at 120 degrees Centigrade for one minute. Finally, a polyurethane latex based topcoat was applied on top of the print coating using a #7 Meyer rod and dried at 120 degrees for two minutes. The decorated surface was smooth and consistent. The thickness of the final structure was 0.013 inches with a basis weight of 93 #/3,000 $ft^2$. The creasability angle was 90 degrees.

Example 7

This example was a polyurethane cellular layer was produced on a saturated creped cellulose base sheet backing layer, that was 0.005 inches thick. Polyurethane latex was mechanically frothed and 0.020 inches of wet coating was applied to the creped side of a thin cellulose backing layer and then dried at 120 degree Centigrade for two minutes. The thickness of the cured material was 0.030 inches with a basis weight of 170 lb/3,000 $ft^2$. The creasability angle was 170 degrees.

Example 8

In this example, a colored polyurethane cellular layer was generated on a cellulose base stock, i.e., backing layer, that was 0.006 inches thick. Polyurethane latex was blended with a red pigment and then mechanically frothed. The froth was applied to a saturated backing layer. The structure was then placed into the oven and dried at 120 degrees Centigrade for two minutes. The thickness of the cured material was 0.016 inches with a basis weight of 122 #/3,000 $ft^2$. The creasability angle was 75 degrees.

Example 9

This is a cellulose base stock, i.e., backing layer, that has been saturated with a polyurethane latex froth. A proprietary polyurethane is frothed and placed into a saturation pan. Next, a cellulose backing layer is dipped into the saturation pan and then passed through a pressurized nip. The resulting structure was then dried at 120° C. for two minutes and had a saturation level of 78% and a creasability angle of 169 degrees.

Example 10

This example was a polyacrylic cellular layer on FiberMark 9971-006 F/E base stock that was 0.0061 inches thick. Joncryl 74-A was mechanically frothed and 0.010 inches of wet coating was applied to the FiberMark 9971 base substrate, i.e., the backing layer. The structure was dried in a forced air oven for 2 minutes at a temperature of 110° C. The finished material's total basis weight was 202.5 grams per square meter, 0.0146 inches thick and had a creasability angle of 76°.

Example 11

This example was a styrene butadiene polymeric cellular layer on FiberMark 9971-006 F/E base stock that was 0.006 inches thick. GenFlo8125™ from Omnova was mechanically frothed and 10 mil wet coating was applied to the 9971 base backing layer, from FiberMark. The structure was dried at 110° Centigrade for two minutes. The cellular layer density was 0.25 $g/cm^3$ with a thickness of 13.2 mils. The creasability angle of the multi-layered material was 60°.

Example 12

This example was a polyacrylic cellular layer on FiberMark 9971-006F/E base substrate that was 0.006 inches thick, a FiberMark acrylic 730042 was mechanically frothed and 10 mil wet coating was applied to a 9971 FiberMark base substrate, i.e., backing layer. The cellular layer density was 0.16 $g/cm^3$ with a thickness of 0.0132 inches and the combined multi-layered material had a creasability angle of 60°.

Example 13

This example is a blend of different acrylic polymers in a cellular layer on FiberMark 9971-006F/E base substrate that was 0.0061 inches thick. A 50:50 blend of Carbobond 26387 from Lubrizol and Joncryl 2640 was mechanically frothed and 0.010 inches of wet coating was applied to the FiberMark 9971 base substrate, i.e., backing layer. The wet structure was dried in an oven at 110° C. for 2 minutes. The resultant material was 0.0146 inches thick a total basis weight of 183.1 $g/m^2$ and had a creasability angle of 49°.

Example 14

This example is another elastomeric polymer, an acrylic/urethane copolymer, based cellular layer on FiberMark 9971-006F/E base substrate that was 0.006 inches thick. Three variations of urethane/acrylic copolymers, Titan T-6301, Titan T6330 and Titan T6300, were mechanically frothed and applied to the FiberMark 9971 base substrate, i.e., backing layer, and dried at 110° C. The resultant structures had the following properties: Titan T6301 had a cellular layer caliper of 0.00515 inches, basis weight of 32 lb/3000 $ft^2$ and the multi-layer composite had a creasability angle of 82°; Titan T-6330 had a cellular layer caliper of 0.00565 inches, basis weight of 38 lb/3000 $ft^2$ and the multi-layer composite material had a creasability angle of 110°; and Titan T6300 had a cellular layer caliper of 0.0074 inches, basis weight of 38 lb/3000 $ft^2$ and the multi-layer composite material had a creasability angle of 73°.

Example 15

In this example, a polyurethane cellular layer was placed on a bleached kraft paper that was 0.017 inches thick. A polyurethane was mechanically frothed and applied to a craft BV061 FiberMark base substrate (backing layer). The cellular layer density was 0.30 $g/cm^3$ with a thickness of 11 mils. The creasability angle of the multi-layered material was 120°.

Example 16

This example is a polyurethane cellular layer on the wire side of FiberMark paper BVTR571-PSP-X19×19, a thin saturated and coated cellulose nonwoven base substrate, 0.004 inches thick. Polyurethane, Unithane FC-807SF, was mechanically frothed and a 0.010 inch thick wet coating was applied to the wire side coated FiberMark BVTR571 base substrate, i.e., backing layer, that was 0.004 inches in thickness. The wet structure was dried in an oven at 109° C. for 3 minutes. The resultant materials had a total thickness of 0.0118 inches, a total basis weight of 85.7 lb/3000 $ft^2$ and a creasability angle of 52°.

Example 17

This example was a thick polyurethane cellular layer on a cellulose backing layer that was 0.006 inches thick. A proprietary polyurethane, HH113866T1, was mechanically frothed and was applied to the felt side of a latex saturated cellulose base stock backing layer. The resulting structure was placed in the oven at 110 degrees Centigrade for three minutes. The thickness of the cellular substrate component was 0.066 inches with a basis weight of 275 lb/3,000 $ft^2$. The creasability angle of the multi-layered material was 165 degrees.

Materials described in the previous examples can be used as covering materials for boxes, binders, agendas among other applications.

Example 18

In the following example, material from Example 6 above, having a crease angle of 90°, and a commercial polyurethane product, having a crease angle of 180°, are used as the facing material to cover chip board boxes typical of those used in commercial applications. The wrapping/covering method used is typical of hand production.

Standard chipboard structures for lids 5"×4"×1" deep were scored on a CNC machine to make crisp folds. A thin layer of Elmer's Glue-All™ was applied to the center and longer flaps of the chipboard structure. The top of chipboard structure was glued to back side of facing material w/overlaps on all sides. The overlaps were trimmed to provide a consistent overturned edge and included flaps that extended along the long sides to secure folded piece. A thin layer of glue was applied to the underside of facing material at both long sides. The long and short sides of structure were folded up to make crisp corners. The sides were held in place by adherence of the extended flaps of facing material to short sides of structure. Extra facing material was turned toward the inside lid, so the extra facing material adhered neatly to long side and around the inside corner. Then a thin layer of glue was applied to underside of facing material along both short sides and the outside is adhered to the inner edge of structure to complete the wrap.

The following observations were made during this wrapping procedure:

- Commercial polyurethane (PU) was rubbery, and drapey quality makes it harder to handle and to cut with a knife.
- Commercial PU's tended to slide away from the blade.
- Glue was difficult to spread thinly and evenly on the commercial PU's slippery back surface.
- Commercial PU's surface showed any small imperfections in the underlying chipboard and glue layers.
- The commercial PU's thickness made for more rounded corners and the cut edge definitely showed a lighter color at the cut edge.

The following observations were made during the above discussed wrapping procedure with Example 6, as discussed above:

- The Example 6 material had better lay flat and was easy to handle and cut.
- Glue application on the Example 6 material was very easy.
- The Example 6 material masked small imperfections in the substructure.
- The Example 6 material made good folds and the corners were crisp and finally, the cut edges did not show.

With respect to creasability, in embodiments of the present invention, angles between about 20° to about 160° are preferred. In particular, with angles below 20° the creasing leaves a visual mark on the surface and/or is a result of structural damage. It has been determined that some resilience is needed in the structure to perform well. At very high angles the resilience has enough force to pull the material way from any flat surface that it is glued to before the glue sets. Angles between about 30° to about 150° are more preferred and between about 50° and about 130° are most preferred.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. While the dimensions and types of materials described herein are intended to define the parameters of the invention, they are by no means limiting and are exemplary embodiments. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," "third," "upper," "lower," "bottom," "top," etc. are used merely as labels, and are not intended to impose numerical or positional requirements on their objects. Further, the limitations of the following claims are not written in means-plus-function format and are not intended to be interpreted based on 35 U.S.C. § 112, sixth paragraph, unless and until such claim limitations expressly use the phrase "means for" followed by a statement of function void of further structure.

This written description uses examples to disclose several embodiments of the invention, including the best mode, and also to enable one of ordinary skill in the art to practice the embodiments of invention, including making and using any devices or systems and performing any incorporated methods. The patentable scope of the invention is defined by the claims, and may include other examples that occur to one of ordinary skill in the art. Such other examples are intended to be within the scope of the claims if they have structural elements that do not differ from the literal language of the claims, or if they include equivalent structural elements with insubstantial differences from the literal languages of the claims.

As used herein, an element or step recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising," "including," or "having" an element or a plurality of elements having a particular property may include additional such elements not having that property.

Since certain changes may be made in the multilayer material, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A multi-layer material suitable for use as a covering for an article, the material comprising:

an elastomeric, polyurethane cellular layer having a density between about 0.2 g/cc to about 0.35 g/cc;

a nonwoven, cellulose based substrate backing layer, the backing layer being approximately 0.006 inches thick and being a cellulose based non-woven paper saturated with latex, and having between about 12% to about 60% saturation based on dry fiber content; and a plurality of coatings on the polyurethane cellular layer;

wherein the material is approximately 0.013 inches in thickness;

wherein the material has a basis weight of approximately 93 lbs./3,000 $ft^2$; and wherein the material has a creasability angle of between about 50° and about 130° such that the material is resilient to an extent that a visual mark is not created on a surface of the material after folding, yet not so resilient that the material will pull away from a surface of the article when the material is folded over an edge of the article and adhered to the surface of the article.

2. The material of claim 1 wherein at least one of the coatings comprises a latex emulsion.

3. The material of claim 1 wherein the coatings are selected from the group consisting of polyurethanes, polyacrylics, polystyrene butadiene, polyethyelene vinyl acetate, vinyl acetate ethylene polymers, polyolefins, or combinations thereof.

4. The material of claim 1 wherein at least one of the coatings includes a pigment filler, dye, or colorant.

5. The material of claim 1 wherein the polymeric cellular layer comprises a flexible polymeric matrix having open and closed cells in a density range of about 0.15 g/cc to about 0.8 g/cc.

6. The material of claim 1 wherein the polymeric cellular layer is froth-formed via mechanical generation of a froth at a density ranging from about 0.5 to 8 lb/gal by metering pressurized air or gas into a latex polymer liquid stream.

7. The material of claim 1 wherein the polymeric cellular layer is selected from the group consisting of polyurethanes, polyacrylics, polystyrene butadiene rubbers, polyethylene vinyl acetates, and blends thereof.

8. The material of claim 1 wherein the polymeric cellular layer includes a pigment filler, dye or colorant.

9. The material of claim 1 in which the at least one polymeric cellular layer is a plurality of polymeric cellular layers.

10. The material of claim 1 wherein the material is embossed to create a texture.

11. The material of claim 1, wherein:

the creasability angle is approximately 90°.

12. The material of claim 11, wherein:

the plurality of coatings include at least a print coating and a polyurethane latex based topcoat.

13. The material of claim 1, wherein:

the material is configured to be affixed to the article so as to form an integral part of the article.

14. The material of claim 1, wherein:

the creasability angle is determined by placing together two edges of a 4-inch by 4-inch sample of the material so that an outward facing surface of the sample of material is touching itself, rolling a 20-pound weight over the sample of material while being held in such position to impart a crease, holding one edge of the sample of material against a flat surface while the other edge is released and, after 30 seconds, measuring the angle that forms between the edge that is held down and the edge that rebounds after being released.

15. A book cover having a covering material, comprising:

a book cover; and a cover material adhered to an outward facing surface of the book cover, folded over an edge of the book cover and adhered to an inner facing surface of the book cover, the cover material including:

an elastomeric, polyurethane cellular layer having a density between about 0.2 g/cc to about 0.35 g/cc;

a nonwoven, cellulose based substrate backing layer, the backing layer being approximately 0.006 inches thick; and a plurality of coatings on the polyurethane cellular layer;

wherein the cover material is approximately 0.013 inches in thickness;

wherein the cover material has a basis weight of approximately 93 lbs./3,000 $ft^2$; and wherein the cover material has a creasability angle of between about 20° and about 160° such that the cover material is resilient to an extent that a visual mark is not created on a surface of the material after folding, yet not so resilient that the cover material will pull away from the inner facing surface of the book cover when the cover material is folded over the edge of the book cover and adhered to the inner facing surface of the book cover.

16. The book cover of claim 15, wherein:

the creasability angle is determined by placing together two edges of a 4-inch by 4-inch sample of the material so that an outward facing surface of the sample of material is touching itself, rolling a 20-pound weight over the sample of material while being held in such position to impart a crease, holding one edge of the sample of material against a flat surface while the other edge is released and, after 30 seconds, measuring the angle that forms between the edge that is held down and the edge that rebounds after being released.

17. An article, comprising:

one of a box, binder, book, journal or diary, the box, binder, book, journal or diary having an outward facing surface; and a covering material adhered to the outward facing surface, the covering material including:

an elastomeric, polyurethane cellular layer;

a nonwoven, cellulose based substrate backing layer, the backing layer being approximately 0.006 inches thick; and a plurality of coatings on the polyurethane cellular layer;

wherein the covering material is approximately 0.013 inches in thickness;

wherein the covering material has a basis weight of approximately 93 lbs./3,000 $ft^2$; and wherein the covering material has a creasability angle of between about 20° and about 160°.

18. The article of claim 17, wherein:

the elastomeric, polyurethane cellular layer has a density between about 0.2 g/cc to about 0.35 g/cc.

19. The material of claim 1, wherein:

wherein each of the plurality of coatings is configured to change at least one of a function, durability, color and/or tactile visual aesthetic of the material.

20. The material of claim 1, wherein:

the polymeric cellular layer is directly attached to the backing layer through adhesion that results from application of froth directly to the backing layer and curing.

* * * * *